United States Patent [19]

Podrini

[11] Patent Number: 4,739,972

[45] Date of Patent: Apr. 26, 1988

[54] METHOD FOR CONTINUOUSLY CASTING MOLTEN METAL

[75] Inventor: Maurizio Podrini, Rome, Italy

[73] Assignee: Centro Sperimentale Metallurgico S.p.A., Rome, Italy

[21] Appl. No.: 917,515

[22] Filed: Oct. 10, 1986

Related U.S. Application Data

[62] Division of Ser. No. 724,298, Apr. 17, 1985, Pat. No. 4,632,368.

[30] Foreign Application Priority Data

May 8, 1984 [IT] Italy ..... 48151 A/84

[51] Int. Cl.[4] ..... B22D 11/10

[52] U.S. Cl. ..... 266/44; 266/229; 164/335; 164/437; 75/58

[58] Field of Search ..... 266/44, 229, 275; 164/437, 337, 335; 222/606

[56] References Cited

FOREIGN PATENT DOCUMENTS 0001252 1/1981 Japan ..... 164/437

1536175 12/1978 United Kingdom ..... 164/437

*Primary Examiner*—L. Dewayne Rutledge

*Assistant Examiner*—S. Kastler

*Attorney, Agent, or Firm*—Young & Thompson

[57] ABSTRACT

A continuous casting tundish has a horizontal baffle intermediate its height. The baffle has a hole therethrough, to receive the downward flow of molten steel from the snorkel of a ladle, which flow educts steel through the hole and with it any desired additives such as alloying and/or refining agents. The space below the baffle is of lesser cross sectional area than the space above the baffle, and at least one end of the space below the baffle communicates with the space above the baffle, so that circulating flow of steel through the hole, below the baffle, and back over the baffle and again through the hole, is induced, that flow being turbulent below the baffle and laminar above the baffle. The tundish has the usual casting holes in its bottom.

4 Claims, 5 Drawing Sheets

METHOD FOR CONTINUOUSLY CASTING MOLTEN METAL

Figure 1:
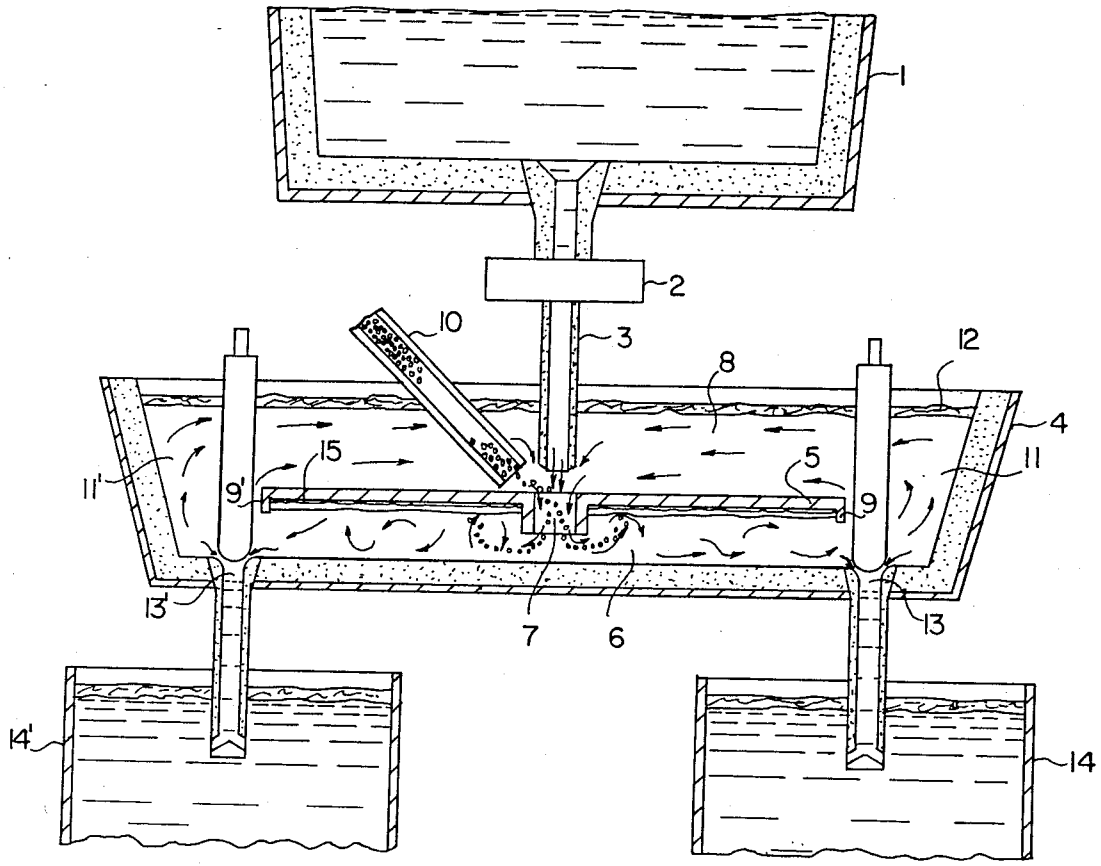

This application is a division of application Ser. No. 724,298, filed 4/17/85, now U.S. Pat. No. 4,632,368.

This invention concerns a method of continuous casting molten metals. More precisely it relates to a method which exploits the energy of the liquid steel flowing from the ladle to ensure the effective mixing of steel and additives such as, for instance, alloying or deoxidation and/or desulphurization agents, to facilitate the course of the reactions without gaseous phase losses, to improve separation of the products of reaction and to create more efficient steel temperature and composition homogenization conditions.

It is known, of course, that in steelmaking, technological progress in the development of post-refining systems has been rapid of late. This is because the transfer of such treatments to a point on the production line ever closer to that where solidification occurs, permits a reduction in disturbances caused by reoxidation, as a result of contact with the air and the refractories.

The treatments in question consist in adding to the liquid steel various agents for the purpose of attaining given metallurgical objectives such as deoxidation, desulphurization and modification of the nature and the morphology of inclusions. These additions are normally made in the ladle which, among other things, has the advantage of a sufficient head of steel to ensure that the reactions between the additives and the steel run to completion and that a satisfactory yield is obtained with those reagents which liquefy or gasify at the temperature of the molten steel and normal pressure.

In steelworks with continuous casting systems, there exists the possibility of performing metallurgical treatments in the last container (tundish) occupied by the liquid steel before this solidifies in the mould. To do this, however, certain modifications must be made to the tundish, owing to the short length of time the steel remains there and the much lower head available than in the ladle.

The changes that have been made to date to modify the mixing process and to increase the time the steel remains in the tundish do not appear really suitable to guarantee either efficient mixing or sufficient contact time between the additives and the liquid steel.

The purpose of the present invention is to overcome these difficulties by a cheap, simple modification to the structure of the tundish by which a novel method for continuously casting molten metals can be practiced.

According to the invention, the tundish is equipped with a horizontal baffle which separates it into two superimposed zones, the lower one preferably with a smaller cross-section than the upper one. This baffle is fixed to at least one of the long vertical walls of the tundish and can be fixed to one of the short walls too. The baffle also has projections or fins extending downwards from the free edges, and a conduit at the point where the liquid steel runs from the ladle into the tundish; this conduit has a larger section than that of the liquid steel stream and extends into the lower zone of the tundish.

In the case of the continuous casting of slabs, it is possible to have one or, at the most, two casting lines for each tundish. If there are two lines and hence the tundish has two casting holes, the horizontal baffle is preferably fixed to both the long walls of the tundish—the aforesaid conduit being located centrally—and terminates towards the extremities of the tundish, before each of the casting holes.

If there is only one line, the baffle can be fixed to the two long walls of the tundish and to the short wall farthest from the casting hole; in this case the conduit is located near the short side of the tundish, farthest from the casting hole.

Alternatively, the horizontal baffle can be fixed to just one of the long walls of the tundish and terminate towards the other long wall and in the direction of the casting hole, with a vertical extension which is fixed to the bottom of the tundish, so as to delimit a channel, open only at the extremity of the tundish farthest from the casting hole. In this case, the conduit in the horizontal baffle is located near the casting hole from which it is separated by means of the vertical extension. In this manner, a completely free passage is created alongside the closed channel; this free passage extends along the whole length of the tundish and it is needed to permit the tundish to be emptied completely when the casting is finished.

In the case of the continuous casting of billets, the tundish serves at least four lines; therefore the horizontal baffle is fixed to only one of the long vertical walls and it terminates towards the other long wall against a further vertical wall set lengthwise within the tundish and extending upwards from the bottom of the tundish to beyond the horizontal baffle so as to rise above the steady-state level of the liquid steel.

This further vertical wall thus bounds a channel that is closed at the top by the horizontal baffle, and a channel, open towards the top, which has the casting holes at the bottom. With this arrangement, the conduit in the horizontal baffle is located centrally.

During steady state operation, the liquid steel flows from the ladle to the tundish through a refractory tube, known as the snorkel, which is partly immersed in the steel in the tundish, and terminates on the centreline of the conduit of said horizontal baffle and not far from it. The necessary additives, e.g. calcium metal are introduced near this conduit by devices that are already known and so they are not described here.

According to the present invention, the above arrangement (end part of snorkel - conduit through horizontal baffle) acts as an ejector, so that the stream of liquid steel flowing from the snorkel to the conduit in the horizontal baffle, draws liquid steel through the conduit from the upper to the lower parts of the tundish. This suction action ensures that the additives introduced near the conduit are drawn into the lower zones where they tend to rise, being generally less dense than the liquid steel, but their ascent is arrested by the lower face of the horizontal baffle where they are detained by the fins extending downwards from the free edges of the baffle.

The mutually-related sizing of the upper and lower zones of the tundish, together with the force of the stream flowing from the ladle and the presence of the horizontal baffle are such as to ensure that the flow of steel is very turbulent only in the lower zone, thus assuring good mixing of liquid steel and additives.

In the upper zone, instead, the flow of steel is slower than in the lower zone and it is laminar, so the particles of impurities formed by the reaction between the additive and the molten metal can readily float to the surface where they are enclosed in the layer of slag.

Furthermore the mutually-related sizing of the upper and lower zones and of the casting holes, is such that, statistically, the steel tapped from the ladle circulates at least two or three times between the lower and upper zones before being cast into the mould. This ensures the right reaction times between metal and additive and also appropriate flotation times to guarantee that the particles of impurities are removed.

Figure 2:
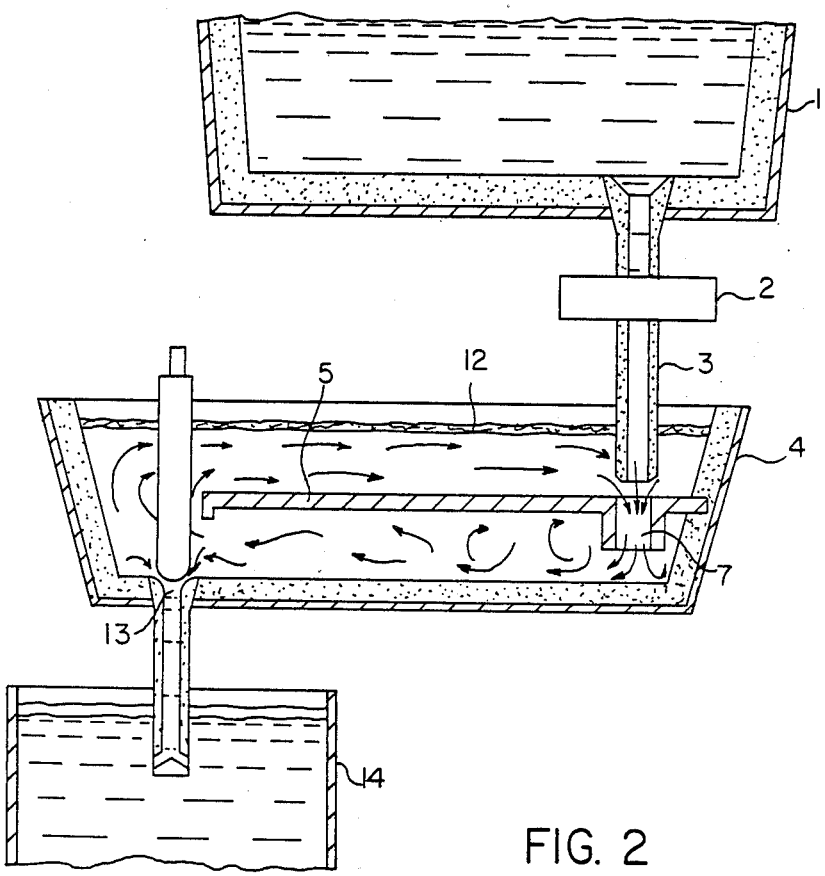
Figure 4:
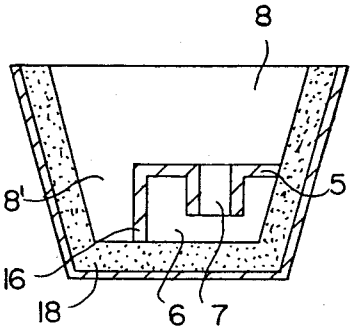
Figure 3:
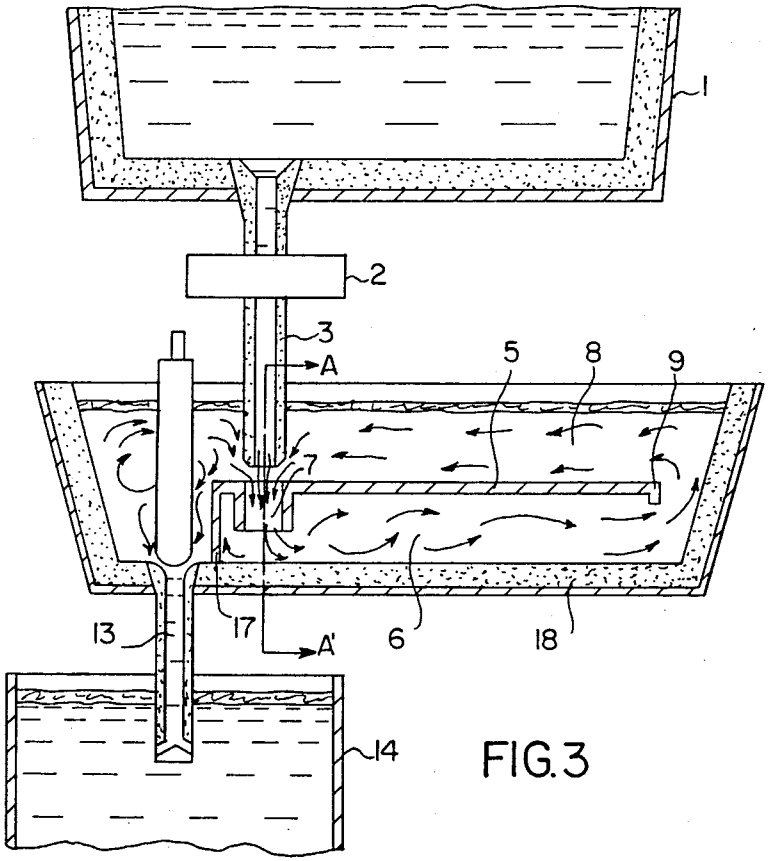
Figure 5:
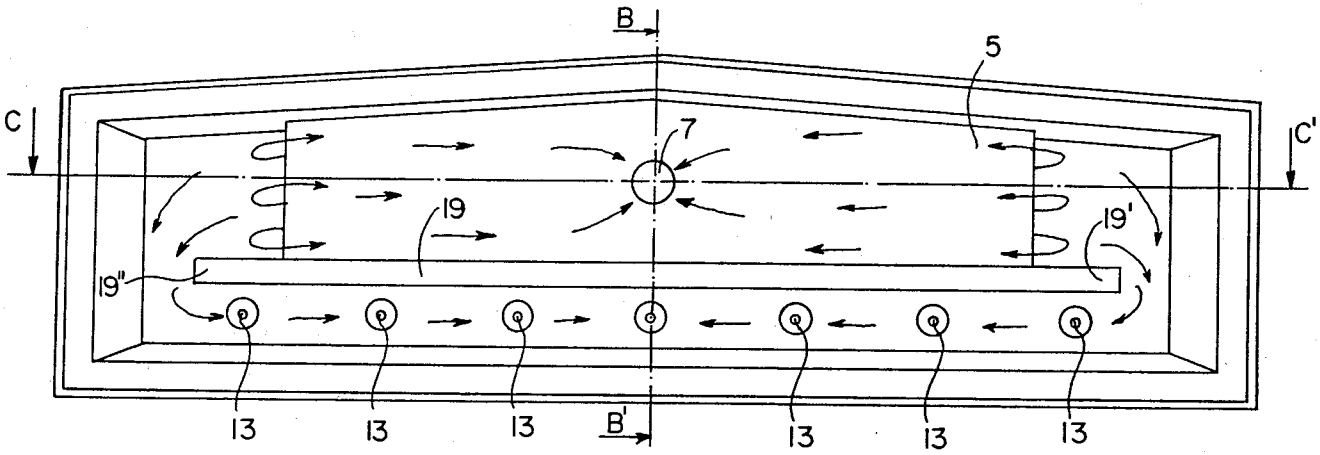
Figure 6:
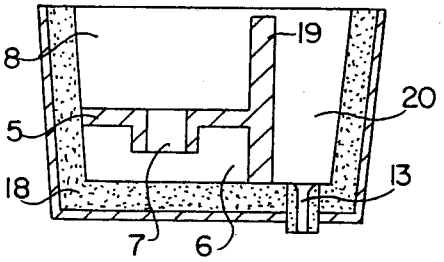
Figure 7:
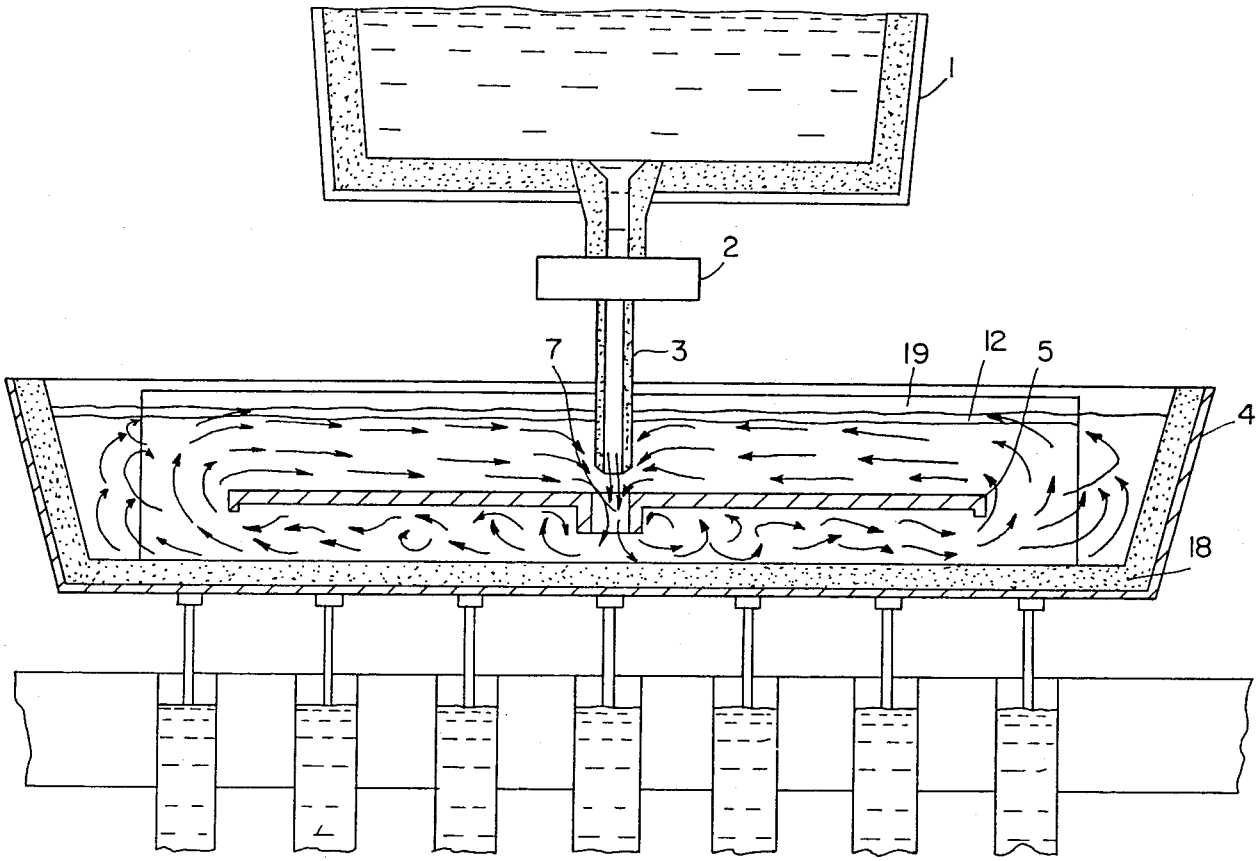

The present invention will now be described in relation to some of its possible embodiments, cited purely by way of example but in no way limiting the objects and precepts of the invention. These embodiments are illustrated in the accompanying Figures where:

FIG. 1 is a longitudinal section of a tundish for practicing the method of the present invention, in the version for the continuous casting of slabs on two lines, FIG. 2 is a longitudinal section of a tundish, in the version for the continuous casting of slabs on only one line, FIG. 3 is a longitudinal section of a tundish, in another version for the continuous casting of slabs on only one line, FIG. 4 is a cross-section on of the tundish on line A—A' of FIG. 3, FIG. 5 is a bird's-eye view of a tundish for the continuous casting of billets on seven lines, FIG. 6 is a cross-section on B—B' of FIG. 5, FIG. 7 is a longitudinal section on C—C' of FIG. 5.

With reference to FIG. 1, the liquid steel contained in ladle flows out through nozzle 2 and snorkel 3 into tundish 4. Under steady-state conditions, the liquid steel flowing through the end part of snorkel 3 through conduit 7 performs a whole series of very important functions owing to the particular inter-relationship of snorkel 3, conduit 7 and horizontal baffle 5 fixed to both long walls of tundish 4.

As will be readily appreciated, this particular arrangement forms an ejector which exploits the energy of the steel running from the ladle into the tundish to create a very turbulent flow of steel in the lower zone 6 bounded by baffle 5. This turbulence gradually decreases towards the right and left ends of said lower zone, where the steel in the terminal parts 11 and 11' of the tundish rises into the upper zone 8. Here, owing to the suction effect of the ejector and because of the fact that zone 8 has a larger section than zone 6, the flow of steel becomes slower and laminar.

The arrows in FIG. 1 indicate the flow conditions of the steel in the various zones of the tundish.

Refining agents or alloying elements in particle form, for example, can be added in the ejector suction zone near the terminal part of snorkel 3, via a submerged tube 10 or other known means. These additives are then drawn through conduit 7 into the lower zone 6, where they are efficiently mixed by the turbulent flow of the steel. If the additive is lighter than the steel, as is the case with deoxidizing and/or desulphurizing substances such as Ca, Mg, etc. the material will tend to rise but most of it will be trapped as a liquid or gaseous layer 15 against the lower face of the baffle 5 by the fins 9, 9'.

The inclusions of oxides and/or sulphides which form will be dragged into the upper zone 8 where, thanks to the slower, laminar flow of steel, they can rise to the surface and will be trapped by the layer of slag 12.

The lower zone 6, the upper zone 8 and the casting holes 13 and 13' are so sized that statistically a given quantity of steel which arrives in the tundish circulates at least two or three times around the lower and upper zones before being cast into moulds 14 and 14' via holes 13 and 13'.

It is thus possible to ensure that the cast product contains far fewer inclusions than is normally the case with conventional, known tundishes.

The other Figures illustrate diverse embodiments of the present invention, all operating in the same manner as described in FIG. 1. In particular, in FIG. 2, illustrating one-line continuous casting of slab, the baffle 5 is fixed to one of the short walls—namely that farthest from the casting hole—as well as to the two long walls. In this case, of course, conduit 7 is set as far as possible from casting hole 13.

FIGS. 3 and 4 illustrate another possible solution for a one-line continuous casting unit. In order to guarantee that a given quantity of steel passes at least once through the upper zone 8 before being cast into the mould, the horizontal baffle 5 is fixed to one of the long sides of the tundish and ends, towards the other long wall and the casting hole 13 with vertical extensions 16 in FIG. 4 and 17 in FIG. 3, which are also fixed to the bottom 18 of the tundish.

In this case, conduit 7 is located near this extension 17. As can be seen in FIG. 4, this special solution results in the presence of lower zone 6 having the shape of a narrow channel (FIGS. 3 and 4), open at only one of its ends. The upper zone 8 extends above the lower zone and at its side with channel 8' which helps slow down the flow of molten steel and render it laminar, while also having the function of permitting total evacuation of the lower zone 6, once the casting has been finished.

FIGS. 5, 6 and 7 illustrate a possible embodiment of the present invention in the case of continuous casting of billets with several lines: seven in the case in point.

In this regard, with reference to FIG. 5, which is a bird's eye view of the tundish as per this invention, conduit 7 in baffle 5 is positioned on the median transverse plane of the tundish being offset towards the long wall that is farthest from casting holes 13. Baffle 5 is fixed to that long wall and ends in the direction of casting holes 13 but prior to these with a vertical extension 19 which runs from the bottom of the tundish 18 to above the maximum level of the slag layer 12. This extension 19 is longer than the horizontal baffle 5 and thus projects from this towards the short walls of the tundish with projections 19' and 19''. In this way (see also FIG. 6) three zones are formed where the molten steel flows in a different manner. In the lower and upper zones, respectively, the steel behaves as already discussed in relation to FIG. 1.

Pilot plant trials have demonstrated that with the tundish as per this invention it is possible, for instance, to reduce the sulphur content from 50–80 to 15–20 ppm, employing calcium-containing alloys as the desulphurizing agent, while there is a great improvement in both the shape of the inclusions, which are completely globularized and in their number, which is reduced by about 60%. Furthermore excellent uniformity in steel temperature is achieved, within the limits of accuracy of temperature measurements with PtRh6–PtRh30 thermocouples (±5° C.).

I claim:

1. A method of continuously casting molten metal, comprising flowing metal from a ladle through a nozzle submerged in a bath of molten metal in a tundish having a horizontally elongated horizontal baffle intermediate its height and having a vertical conduit opening through the baffle in alignment with but spaced from the nozzle, providing a flowpath along the lower region of the nozzle below the baffle in a direction away from said conduit and providing a flowpath above the baffle in a direction toward said conduit whereby flow of metal from the nozzle to and through the conduit educes flow of molten metal along said flowpaths, and continuously casting molten metal from the tundish at at least one point spaced horizontally from said conduit.

2. A method as claimed in claim 1, and circulating the molten metal a plurality of times from below the baffle to above the baffle and through the conduit prior to casting the metal.

3. A method as claimed in claim 1, and so dimensioning said flowpaths relative to the flow rate of molten metal through the nozzle and conduit that the molten metal flows being the baffle with turbulent flow and above the baffle with laminar flow.

4. A method as claimed in claim 1, and adding additives for metallurgical treatment of the molten metal close to and upstream from the conduit.

* * * * *